US008025924B2

(12) United States Patent
Ohira et al.

(10) Patent No.: US 8,025,924 B2
(45) Date of Patent: Sep. 27, 2011

(54) CAST-COATED PAPERS AND PROCESSES FOR PREPARING THEREOF

(75) Inventors: Yukiko Ohira, Tokyo (JP); Hidehiko Kai, Tokyo (JP); Kiyoshi Hatakeyama, Tokyo (JP); Hideaki Nisogi, Tokyo (JP); Hirokazu Morii, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 864 days.

(21) Appl. No.: 10/576,188

(22) PCT Filed: Oct. 15, 2004

(86) PCT No.: PCT/JP2004/015275

§ 371 (c)(1),
(2), (4) Date: Feb. 7, 2007

(87) PCT Pub. No.: WO2005/038134

PCT Pub. Date: Apr. 28, 2005

(65) Prior Publication Data

US 2007/0221349 A1 Sep. 27, 2007

(30) Foreign Application Priority Data

| | | |
|---|---|---|
| Oct. 15, 2003 | (JP) | 2003-354997 |
| Nov. 20, 2003 | (JP) | 2003-390417 |
| Mar. 31, 2004 | (JP) | 2004-107135 |
| Mar. 31, 2004 | (JP) | 2004-107991 |

(51) Int. Cl.
*D21H 19/42* (2006.01)
*D21H 19/36* (2006.01)
*D21H 25/14* (2006.01)

(52) U.S. Cl. ..... 427/362; 427/365; 162/135; 162/136; 162/162; 162/164.1; 162/181.8; 162/205

(58) Field of Classification Search ..... 162/135–137, 162/158, 181.1, 181.8, 164.1, 168.1, 179, 162/204–205, 162; 427/355, 361–362, 365; 428/340–341, 195.1, 211
See application file for complete search history.

(56) References Cited

U.S. PATENT DOCUMENTS

| | | | | | |
|---|---|---|---|---|---|
| 4,581,257 | A * | 4/1986 | Kondo et al. | 427/336 |
| 4,620,992 | A * | 11/1986 | Nojima et al. | 427/362 |
| 4,686,119 | A * | 8/1987 | Nojima et al. | 427/362 |
| 4,900,583 | A * | 2/1990 | Hirabayashi et al. | 427/542 |
| 5,043,190 | A * | 8/1991 | Katsumata et al. | 427/362 |
| 5,169,715 | A * | 12/1992 | Maubert et al. | 428/331 |
| 5,275,846 | A * | 1/1994 | Imai et al. | 427/362 |
| 5,360,657 | A * | 11/1994 | Kano et al. | 428/207 |
| 5,993,960 | A * | 11/1999 | Nakayama et al. | 428/345 |
| 6,406,796 | B1 * | 6/2002 | Ohmura et al. | 428/511 |
| 6,929,845 | B2 * | 8/2005 | Kai et al. | 428/195.1 |
| 7,101,459 | B2 * | 9/2006 | Nisogi et al. | 162/135 |
| 7,160,419 | B2 * | 1/2007 | Suzuki et al. | 162/135 |
| 7,208,068 | B2 * | 4/2007 | Nisogi et al. | 162/135 |
| 2002/0035949 | A1 * | 3/2002 | Hiorns et al. | 106/417 |
| 2004/0048087 | A1 * | 3/2004 | Kai et al. | 428/537.5 |
| 2004/0110885 | A1 * | 6/2004 | Husband et al. | 524/447 |
| 2004/0197496 | A1 * | 10/2004 | Song et al. | 428/32.25 |
| 2005/0016701 | A1 * | 1/2005 | Nisogi et al. | 162/135 |
| 2006/0163533 | A1 * | 7/2006 | Batz-Sohn et al. | 252/182.32 |
| 2007/0221349 | A1 * | 9/2007 | Ohira et al. | 162/137 |

FOREIGN PATENT DOCUMENTS

| | | | |
|---|---|---|---|
| EP | 1300512 | A1 * | 4/2003 |
| JP | 1-111090 | | 4/1989 |
| JP | 9-31891 | | 2/1997 |
| JP | 10-18197 | | 1/1998 |
| JP | 10-168792 | | 6/1998 |
| JP | 2000345493 | A * | 12/2000 |
| JP | 2002-88679 | | 3/2002 |
| JP | 2002-096553 | | 4/2002 |
| JP | 2002138392 | A * | 5/2002 |
| JP | 2003-171893 | | 6/2003 |
| JP | 2003-221797 | | 8/2003 |
| JP | 2006284684 | A * | 10/2006 |
| WO | WO 0201000 | A1 * | 1/2002 |
| WO | WO 0227095 | A1 * | 4/2002 |
| WO | WO 03056101 | A1 * | 7/2003 |
| WO | WO 2005038134 | A1 * | 4/2005 |
| WO | WO 2005064079 | A1 * | 7/2005 |

OTHER PUBLICATIONS

JPO Machine Translation of JP 10-018197, Published on Jan. 20, 1998.*

JPO Machine Translation of JP 09-031891, Published on Feb. 4, 1997.*

JPO Machine Translation of JP 2003-171893, Published on Jun. 20, 2003.*

* cited by examiner

*Primary Examiner* — Jose A Fortuna
(74) *Attorney, Agent, or Firm* — Nixon & Vanderhye P.C.

(57) ABSTRACT

The present invention aims to provide a cast-coated paper having good sheet gloss, printability and productivity and a process for preparing it. Herein disclosed is a cast-coated paper obtained by applying a cast coating layer comprising a pigment and an adhesive on a base paper, and pressing and drying the cast coating layer in the wet state against a heated mirror finishing surface to finish it, characterized in that the cast coating layer contains 50 parts by weight or more of a kaolin having a particle size distribution containing 65% by volume or more of particles in the range of 0.4-4.2 μm per 100 parts by weight of inorganic pigments and further contains a plastic pigment; as well as a process for preparing it.

4 Claims, No Drawings

CAST-COATED PAPERS AND PROCESSES FOR PREPARING THEREOF

This application is the US national phase of international application PCT/JP2004/015275 filed 15 Oct. 2004, which designated the U.S. and claims benefit of JP 354997/2003 filed 15 Oct. 2003, JP 390417/2003 filed 20 Nov. 2003, JP 107135/2004, filed 31 Mar. 2004, and JP 107991/2004 filed 31 Mar. 2004, the entire contents of each of which are hereby incorporated by reference.

TECHNICAL FIELD

The present invention relates to cast-coated papers obtained by applying a cast coating layer based on a pigment and an adhesive on a base paper, and pressing and drying the cast coating layer in the wet state against a heated mirror finishing surface to finish it, and processes for preparing the papers.

BACKGROUND ART

High gloss coated papers known as cast-coated papers are prepared by applying an aqueous coating color based on a pigment and an adhesive on the surface of a base paper to form a cast coating layer, and pressing and drying the cast coating layer in the wet state against a heated mirror finishing metal surface (drum).

Known processes for preparing such cast-coated papers include the wet casting method involving directly pressing a coating layer in the wet state against a heated mirror finishing surface to give a gloss finish; the gel casting method involving gelling a coating layer in the wet state and pressing the gelled layer against a heated mirror drum surface to give a gloss finish; the rewet casting method involving drying a coating layer in the wet state, and then plasticizing the dried layer by rewetting and pressing it against a heated mirror finishing surface, etc.

All these processes for preparing cast-coated papers equally involve pressing and drying a cast coating layer in the wet or plasticized state against a heated mirror finishing surface. However, they have the following disadvantages relating to coating runnability and quality of the resulting cast-coated paper depending on the plastic state of the coating layer. In the wet casting method, the temperature of the mirror drum surface cannot be 100° C. or more because the cast coating layer has low viscosity causing the coating color to boil and the coating layer being broken when the temperature of the mirror drum surface reaches 100° C. or more. The absence of a drying step before casting increases the drying load, resulting in low speed operation.

In the gel casting method, the temperature of the mirror finishing surface can be 100° C. or more because the cast coating layer is gelled. However, the absence of a drying step before casting also increases the drying load and requires that a lot of water contained in the cast coating layer should be smoothly transferred into the base paper layer and evaporated off when it is contacted with the mirror surface drum and moreover, sheet gloss or other quality decreases during casting at very high speed because the gelling degree of the coating layer is difficult to control.

In the rewet casting method, the temperature of the mirror drum surface can be raised to 90-180° C. because the cast coating layer is dried before casting. However, this method has the disadvantage that defects on the so-called cast-coated surface such as pinholes on the cast coating layer surface or uneven adhesion are liable to occur during high speed casting because the plasticity of the cast coating layer is lower than obtained in the wet casting or gel casting method.

In the aspect of qualities of cast-coated paper, print gloss is normally lower than sheet gloss, and therefore, print gloss as expected from sheet gloss cannot be obtained in full-page prints and further improvements in print gloss and cast-coated surface quality would be desirable.

In order to solve these problems, various methods have been proposed. For example, it was proposed that a plastic pigment and a latex having a minimum film-forming temperature of less than 0° C. be added to the cast coating layer (see patent document 1). The cast-coated paper obtained by this method has good sheet gloss, but suffers from low print gloss, insufficient air permeability of the paper and low production efficiency. Another proposal was to define the particle size distribution of the pigment in the cast coating layer (see patent document 2). In the cast-coated paper obtained by this method, print gloss is improved over prior products but is low relative to sheet gloss, and the cast-coated surface quality is also poor. Still another proposal was that a hollow plastic pigment be added to the cast undercoat layer (see patent document 3). The cast-coated paper obtained by this method has improved production efficiency over prior products, but qualities such as cast-coated surface quality and printability are not sufficiently satisfactory.

Patent document 1: JPA HEI 4-146294.
Patent document 2: JPA HEI 10-18197.
Patent document 3: JPA HEI 9-268493.

DISCLOSURE OF THE INVENTION

Problems to be Solved by the Invention

In view of these circumstances, an object of the present invention is to provide a cast-coated paper having good cast-coated surface quality, sheet gloss and printability as well as high productivity.

Means to Solved the Problems

As a result of careful studies to overcome the disadvantages of various processes for preparing cast-coated papers, we succeeded in solving the problems by optimizing the formulation of the cast coating layer and achieved the present invention.

Accordingly, the present invention provides a cast-coated paper obtained by applying a cast coating layer based on a pigment and an adhesive on a base paper, and pressing and drying the cast coating layer in the wet state against a heated mirror finishing surface to finish it, wherein the cast coating layer contains 50 parts by weight or more of a kaolin containing 65% by volume or more of particles having a particle size of 0.4-4.2 μm per 100 parts by weight of inorganic pigments and further contains an organic pigment consisting of a plastic pigment, thereby conferring good cast-coated surface quality and sheet gloss, higher print gloss than sheet gloss and good printability on the cast-coated paper. We also found that cast-coated papers having good cast-coated surface quality, sheet gloss, printability and coatability can be produced at high efficiency by a process for preparing a cast-coated paper comprising applying a coating color based on a pigment and an adhesive on a base paper to form a coating layer, drying the coating layer in the wet state, and then plasticizing it by rewetting and pressing and drying the coating layer against a mirror finishing surface to form a mirror finished cast coating layer, characterized in that the coating color contains 50 parts by weight or more of a kaolin having a particle size distribution containing 65% by volume or more of particles in the range of 0.4-4.2 μm per 100 parts by weight of inorganic pigments and further contains a plastic pigment. The reason why the desired effects are obtained by the present invention is not definitely known, but presumed to be as follows. Typical inorganic pigments for coating compositions have a wide particle size distribution because they include mixtures of fine particles and coarse particles. Monodisperse mixtures consisting of spherical particles having the same particle diameter have the same particle packing density independent of the particle diameter, but polydisperse mixtures consisting of e.g., spheres having two different particle diameters have a particle packing density that depends on the ratio between the larger particle diameter and the smaller particle diameter and the mixing ratio of the two types of particles and that increases as the particle diameter ratio (the particle diameter of smaller particles/the particle diameter of larger particles) decreases. Thus, coating layers formed of a pigment having a narrower particle size distribution have a lower packing density of pigment particles, larger voids in the coating layers and therefore better air permeability as compared with those formed of a pigment having a wider particle size distribution. The plastic pigment enters between pigment particles in the coating layer to form voids, which seem to improve the air permeability of the overall coating layer and smoothly remove moisture during casting, resulting in high-efficiency production. On the other hand, the combination of the kaolin having a narrow particle size distribution and the plastic pigment according to the present invention reduces the packing density of pigment particles in the coating layer, improves the covering power on the base paper, and facilitates transfer of the image of the mirror surface onto the coating layer surface by mirror finishing. As a result, sheet gloss improves and print gloss also appears to improve because the vehicles of printing inks are less likely to be absorbed. Moreover, print gloss becomes higher than sheet gloss presumably because the plastic pigment further facilitates transfer of the image of the mirror surface by the heat of the mirror finishing surface. The plastic pigment is preferably contained in an amount of 5-50 parts by weight per 100 parts by weight of inorganic pigments. In the present invention, the base paper contains an organic compound having the effect of inhibiting interfiber bonding of pulp, thereby improving sheet gloss, print gloss and cast-coated surface quality as well as productivity leading to high efficiency production with good coatability. The reason why such effects are obtained is not definitely known, but presumed as follows. The base paper containing an organic compound having the effect of inhibiting interfiber bonding of pulp improves air permeability because of a lot of voids between pulp fibers. Such base paper with improved air permeability coupled with the coating layer of the present invention further improves air permeability, whereby the temperature of the mirror finishing surface can be raised and therefore, moisture can be smoothly removed during mirror finishing, which in turn leads to mirror finishing at high speed resulting in high efficiency production. The combination of the coating layer defined herein and the base paper containing an organic compound having the effect of inhibiting interfiber bonding of pulp improves adhesion to the mirror finishing surface during pressing against it, thus further facilitating transfer of the image of the mirror finishing surface to the wet coating layer surface, which in turn improves sheet gloss, and at the same time, print gloss and cast-coated surface quality also seem to improve because the vehicles of printing inks are less likely to be absorbed. Print gloss becomes higher than sheet gloss presumably because the plastic pigment further improves the covering power on the base paper by the heat of the mirror finishing surface during mirror finishing. In the present invention, sheet gloss, print gloss and other properties are improved by smoothing the coating layer before it is rewetted with a rewetting solution.

Advantages of the Invention

The cast-coated papers of the present invention have good cast-coated surface quality, high sheet gloss, higher print gloss than sheet gloss and good printability. According to the processes for preparing cast-coated papers of the present invention, cast-coated papers can be prepared at high coating speed and good productivity.

PREFERRED EMBODIMENTS OF THE INVENTION

In the present invention, cast-coated papers are prepared by applying a coating layer based on a specific pigment and an adhesive on a base paper, and pressing and drying the coating layer in the wet state against a heated mirror finishing surface to finish it.

In the present invention, the pigment contained in the cast coating layer comprises 50 parts by weight or more, preferably 60 parts by weight or more, more preferably 70 parts by weight or more of a kaolin having a particle size distribution containing 65% by volume or more of particles in the range of 0.4-4.2 μm per 100 parts by weight of inorganic pigments. In the present invention, a plastic pigment should be contained preferably in an amount of 5-50 parts by weight, more preferably 10-45 parts by weight, still more preferably 20-45 parts by weight per 100 parts by weight of inorganic pigments. The plastic pigment used in the present invention may be a plastic pigment having a solid, hollow or core/shell structure or the like, and these can be used alone or as a mixture of two or more of them as appropriate. Solid plastic pigments are preferably contained in an amount of 10-50 parts by weight, more preferably 20-45 parts by weight per 100 parts by weight of inorganic pigments. Hollow plastic pigments are preferably contained in an amount of 5-25 parts by weight, more preferably 10-23 parts by weight per 100 parts by weight of inorganic pigments. The plastic pigment preferably consists of a polymer based on a monomer such as styrene and/or methyl methacrylate and optionally containing another monomer copolymerizable with the primary monomer. Such copolymerizable monomers include e.g., olefin/aromatic monomers such as a-methyl styrene, chlorostyrene and dimethyl styrene; monoolefin monomers such as methyl (meth)acrylate, ethyl (meth)acrylate, butyl (meth)acrylate, 2-ethylhexyl (meth)acrylate, glycidyl (meth)acrylate, and nitrile (meth)acrylate; and vinyl acetate. For example, at least one or a combination of two or more of the following monomers can be used as appropriate: olefinically unsaturated carboxylic monomers such as acrylic acid, methacrylic acid, itaconic acid, maleic acid, fumaric acid, crotonic acid; olefinically unsaturated hydroxy monomers such as hydroxyethyl acrylate, hydroxyethyl methacrylate, hydroxypropyl acrylate; olefinically unsaturated amide monomers such as acrylamide, methacrylamide, N-methylol acrylamide, N-methoxymethyl acrylamide, N-methoxymethyl methacrylamide; divinyl monomers such as divinyl benzene. These monomers are shown only for illustrative purpose, and any other copolymerizable monomers can be used. The plastic pigment used in the present invention preferably has an average particle diameter of 0.1-1.5 μm, more preferably 0.1-1.0 μm, still more preferably 0.1-0.6 μm as measured by a laser diffraction/scattering particle size distribution analyzer to prevent any loss of air permeability or surface strength.

In the present invention, one or more inorganic pigments conventionally used for coated papers can be selected and used as appropriate, including kaolin other than defined above, clay, delaminated clay, heavy calcium carbonate, light calcium carbonate, talc, titanium dioxide, barium sulfate, calcium sulfate, zinc oxide, silicic acid, silicate salts, colloidal silica and satin white. Especially, improved sheet gloss and print gloss and good cast-coated surface quality can be achieved by including 50 parts by weight or more, more preferably 70 parts by weight or more of a kaolin having a particle size distribution containing 65% by volume or more of particles in the range of 0.4-4.2 μm per 100 parts by weight of inorganic pigments as proposed by the present invention.

In the present invention, the adhesive used in the cast coating layer is not specifically limited, and one or more of adhesives conventionally used for coated papers can be selected and used as appropriate, including synthetic adhesives such as styrene-butadiene copolymers, styrene-acrylic copolymers, ethylene-vinyl acetate copolymers, butadiene-methyl methacrylate copolymers, vinyl acetate-butyl acrylate copolymers, polyvinyl alcohols, maleic anhydride copolymers and acrylic-methyl methacrylate copolymers; proteins such as casein, soybean protein and synthetic proteins; starches such as oxidized starches, cationized starches, urea phosphate-esterified starches, etherified starches such as hydroxyethyl etherified starches, dextrin; and cellulose derivatives such as carboxyethyl cellulose, hydroxyethyl cellulose, hydroxymethyl cellulose. These adhesives are preferably used in a range of 5-50 parts by weight, more preferably 5-30 parts by weight per 100 parts by weight of inorganic pigments.

In the present invention, various additives can be used in the cast coating layer in addition to the pigment and adhesive described above, including ammonium salts or metal salts of inorganic or organic acids such as sodium chloride, ammonium chloride, zinc chloride, magnesium chloride, sodium sulfate, potassium sulfate, ammonium sulfate, zinc sulfate, magnesium sulfate, ammonium nitrate, monobasic sodium phosphate, ammonium phosphate, calcium phosphate, sodium polyphosphate, sodium hexametaphosphate, sodium formate, ammonium formate, sodium acetate, potassium acetate, sodium monochlorate, sodium malonate, sodium tartrate, potassium tartrate, sodium citrate, potassium citrate, sodium lactate, sodium gluconate, sodium adipate, and sodium dioctylsulfosuccinate; and methyl amine, diethanolamine, diethylene triamine, diisopropyl amine, etc. In addition, various additives included in typical coating compositions for coated papers such as dispersants, thickeners, water-retention agents, antifoaming agents, colorants, lubricants, rheology modifiers, waterproofing agents, preservatives and printability improving agents are used as appropriate.

The base paper of the present invention contains conventional pulp, fillers, etc. In the present invention, the type or other features of pulp contained in the base paper is not specifically limited. For example, hardwood kraft pulp (hereinafter referred to as LBKP), softwood kraft pulp (hereinafter referred to as NBKP), thermomechanical pulp, groundwood pulp, recycled pulp and the like are used. Suitable fillers contained in the base paper are known fillers such as ground calcium carbonate, precipitated calcium carbonate, kaolin, clay, talc, hydrated silica, white carbon, titanium oxide, synthetic resin fillers, etc. The fillers are preferably used in an amount of 6% by weight or more on the basis of the weight of pulp. Optionally, aluminum sulfate, sizing agents, paper strength enhancers, yield improvers, coloring pigments, dyes, antifoaming agents or the like may further be contained, if desired.

The base paper of the present invention preferably contains an organic compound having the effect of inhibiting interfiber bonding of pulp as appropriate. The organic compound having the effect of inhibiting interfiber bonding of pulp can be selected by the test below.

A pulp slurry containing 0.3 parts by weight of an organic compound to be tested per 100 parts of pulp based on bone dry weight in a pulp composition designed to form a desired paper was passed through a pilot scale oriented sheet former (available from Kumagai Riki Kogyo Co.) at a rotational speed of 900 rpm, and pressed by the method of JIS8209 and dried with an air dryer at 50° C. for 1 hour. This test paper was left in an atmosphere at 23° C., relative humidity of 50% for 24 hours, and then measured for tensile strength according to JIS P8113. Compounds showing a tensile strength loss are organic compounds having the effect of inhibiting interfiber bonding of pulp of the present invention. Those showing a very small amount of loss have little bulking effect and must therefore be added in large quantities. Those showing greater amount of loss have bulking effect even when they are added in small quantities. Thus, any organic chemicals showing tensile strength loss can be used, but preferred are those showing a loss of 5-30%, especially 8-20% when they are added at 0.3%.

As used herein, the organic compound having the effect of inhibiting interfiber bonding of pulp (hereinafter simply referred to as bonding inhibitor) means a compound having a hydrophobic group and a hydrophilic group and having the effect of reducing tensile strength in the test above. Density reducing agents (or bulking agents) for papermaking recently introduced on the market to increase the bulk of paper are suitable as bonding inhibitors of the present invention, e.g., compounds disclosed in WO098/03730, JPA HEI 11-200284, JPA HEI 11-350380, JPA 2003-96694, JPA 2003-96695, etc. Specifically, ethylene and/or propylene oxide adducts of higher alcohols, polyvalent alcohol-type nonionic surfactants, ethylene oxide adducts of higher fatty acids, ester compounds of polyvalent alcohols and fatty acids, ethylene oxide adducts of ester compounds of polyvalent alcohols and fatty acids, or fatty acid polyamide amines, fatty acid diamide amines, fatty acid monoamides, or condensation products of polyalkylene polyamine/fatty acid/epichlorohydrin can be used alone or as a combination of two or more. Ester compounds of polyvalent alcohols and fatty acids, fatty acid diamide amines, fatty acid monoamides, condensation products of polyalkylene polyamine/fatty acid/epichlorohydrin or the like are preferred. Commercially available bulking agents include Sursol VL from BASF; Bayvolume P Liquid from Bayer; KB-08T, 08W, KB-110, -115 from Kao Corporation; Reactopaque from Sansho Co., Ltd.; PT-205 from Japan PMC Corporation; DZ2220, DU3605 from NOF Corporation; R21001 from Arakawa Chemical industries, Ltd., and these can be used alone or as a combination of two or more. Dull-coated papers of the present invention preferably contain 0.1-10 parts by weight, especially 0.2-1.0 parts by weight of an inhibitor of interfiber bonding of pulp per 100 parts by weight of pulp to provide bulky and soft paper.

The process for preparing the base paper is not specifically limited, and the base paper may be prepared by any process for making acidic, neutral or alkaline papers using e.g., a Fourdrinier paper machine including a top wire or the like or a cylinder paper machine and may also be a mechanical base paper containing mechanical pulp as a matter of course. The base paper may be coated with a surface-treating agent based on a water-soluble polymer for the purpose of improving surface strength or sizing performance. Suitable water-soluble polymers include those commonly used as surface-treating agents such as oxidized starches, hydroxyethyl etherified starches, enzyme-modified starches, polyacrylamides and polyvinyl alcohols, and they can be used alone or as mixtures thereof. In addition to the water-soluble polymers, the surface-treating agents can contain paper strength enhancers intended for waterproofing and improving surface strength and external sizing agents intended for conferring sizing effect. The surface-treating agents can be applied by using coaters such as film transfer roll coaters, e.g., two-roll size press coaters, gate roll coaters, blade metering size press coaters, and rod metering size press coaters. In the present invention, base papers coated with not only such a surface-treating agent but also a coating color containing a pigment and an adhesive used for normal coated papers using any one of the coaters mentioned above or base papers coated with the coating color using a blade coater, roll coater, air knife coater or the like after the surface-treating agent is applied and dried can also be used as a base paper for cast coating. In these cases, the coating mass is desirably about 5-30 g/m$^2$ in dry weight per side. Thus precoated base papers can also be preliminarily smoothed by using a supercalender, soft calender or the like, if desired.

Base papers used in the present invention can be those having a basic weight of about 30-200 g/m$^2$, preferably 50-180 g/m$^2$ used for normal coated papers.

In the present invention, cast coating compositions prepared can be applied on a base paper by using known coaters such as film transfer roll coaters, e.g., two-roll size press coaters, gate roll coaters, blade metering size press coaters, rod metering size press coaters, Sym-Sizers, JF sizers; flooded nip/blade coaters, jet fountain/blade coaters, short dwell time applicator type coaters; rod metering coaters using a grooved rod, plain rod or the like in place of a blade; air knife coaters, curtain coaters or die coaters; preferably at a coating mass of 5-30 g/m$^2$, more preferably 10-20 g/m$^2$ per side of the base paper. After coating, the coating layer in the wet state can be mirror finished by the direct method, or the coating layer in the wet state can be gelled and then mirror finished by the gel casting method, or the coating layer in the wet state can be once dried and then rewetted with a rewetting solution and mirror finished by the rewet casting method, among which the rewet casting method is advantageous in quality and operation. The wet coating layer is dried by using various types of dryers such as steam heated cylinders, hot air dryers, gas heater dryers, electric heater dryers, infrared heater dryers or the like alone or in combination. The coated paper is typically dried to a paper moisture in the range of about 1-10%, desirably about 2-7%, depending on the type of the base paper, the type of the coating composition or other factors. In the present invention, the dried coating layer may be directly mirror finished by the rewet casting method, but the dried coated paper is preferably subjected to a surface-treatment such as smoothing to improve sheet gloss, smoothness and print gloss or the like by using a known surface treatment equipment such as a supercalender using cotton rolls as elastic rolls, a soft nip calender using synthetic resin rolls as elastic rolls, brushing, etc. Especially, the coated paper is treated before mirror finishing to a gloss of 70% (75°) or more, thereby improving qualities such as sheet gloss and print gloss.

In the present invention, the beneficial effect of mirror finishing by pressing the coating layer against a heated mirror finishing surface to give high gloss remarkably appears especially by using a casting method wherein the temperature of the mirror finishing surface is 100° C. or more.

Mirror finishing of the present invention is performed by pressing and drying the coated paper in the wet state against the surface of a heated mirror surface roll with press rolls to finish it, and casting drums or the like can be used as mirror surface rolls.

The coated paper can be pressed against the surface of a mirror surface roll with press rolls to confer gloss under conditions of a surface temperature of the heated mirror surface roll of about 80-200° C. and a pressing pressure of about 30-250 kg/cm.

In the present invention, the rewetting solution is not specifically limited, and normal rewetting agents such as aqueous solutions or emulsions containing about 0.01-3% by weight of a lubricant such as a polyethylene emulsion, fatty acid soap, calcium stearate, microcrystalline wax, surfactant or turkey red oil can be used. Alkalis or phosphate salts such as sodium hexametaphosphate, urea, organic acids or the like can also be used to promote plasticization of the dried coating layer as a matter of course.

The cast-coated papers of the present invention are remarkably effective when the sheet gloss (20°) is 30% or more or the image clarity is 70% or more.

EXAMPLES

The following examples further illustrate the present invention without, however, limiting the invention thereto. Unless otherwise specified, parts and % in the examples mean parts by weight and % by weight, respectively. The cast-coated papers obtained in the examples below were tested by the evaluation methods as shown below.

<Evaluation Methods>

(Analysis of the volume particle size distribution of pigments) The volume particle size distribution of particles was determined using a laser diffraction/scattering particle size distribution analyzer (available from Malvern Instruments under Mastersizer S), and the percentage of particles in the range of 0.4 μm to 4.2 μm was calculated.

(Basis weight) Basis weight was determined according to JIS P 8124:1998.

(Density) Density was determined according to JIS P 8118:1998.

(Cast-coated surface quality) Cast-coated surface was tested according to JIS K 7105 using an image clarity analyzer available from Suga Test Instruments Co., Ltd. under ICM-IT at an incident angle of light of 60° with a slit width of 2 mm.

(Sheet gloss) Gloss before rewetting was measured at 75° according to JIS P 8142:1998 and gloss on the cast-coated surface was measured at 20°.

(Oken air permeability) Air permeability was measured by an Oken air permeability tester according to JAPAN Tappi No. 5.

(Print gloss) A print was prepared using an RI-II type printability tester with 0.30 cc of a sheetfed process ink available from Toyo Ink Mfg. Co., Ltd. (under trade name: TK Hyecho Magenta MZ) and left for a whole day and night, and then the surface of the resulting print was tested according to JIS P 8142:1998 except that the incident angle of light was 20°.

(Cast Coating Runnability)

The cast-coated papers prepared according to the examples below were tested for the adhesion of the cast-coated papers to the casting drum or picking of the cast-coated papers to the casting drum on a scale of three-ratings: o good, □ slightly poor, x poor. Specifically, the evaluation criteria are as follows.

o . . . Neither adhesion nor picking of cast-coated paper to the casting drum occurs.

□ . . . Adhesion or picking of cast-coated paper to the casting drum occurs.

x . . . Adhesion or picking of cast-coated paper to the casting drum occurs so that a cast-coated paper with good quality cannot be produced.

[Selection of a bonding inhibitor] A 1% slurry containing 30 parts of NBKP and 70 parts of refiner groundwood pulp (RGP) was combined and mixed with 0.3 parts of each of the compounds below to prepare a paper stock. This paper stock was passed through a pilot scale oriented sheet former available from Kumagai Riki Kogyo Co. at a rotational speed of 900 rpm, and then pressed by the method of JIS8209 and dried with an air dryer at 50° C. for 1 hour to give a test paper. This test paper was left at a temperature of 23° C., relative humidity 50% for 24 hours and then measured for tensile strength according to JIS P8113. The test results are shown in Table 1.

TABLE 1

| Evaluated compound | Tensile strength (kN/m) | Tensile strength loss (%) | Suitability as bonding inhibitor |
|---|---|---|---|
| KB-08W (Kao) | 1.53 | 13.7 | ○ |
| KB-110 (Kao) | 1.50 | 14.8 | ○ |
| Sursol VL (BASF) | 1.56 | 9.8 | ○ |
| Bayvolume P Liquid (Bayer) | 1.59 | 9.7 | ○ |
| Reactopaque (Sansho) | 1.63 | 7.4 | ○ |
| Isopropyl alcohol | 1.73 | 1.7 | □ |
| Starch | 1.85 | −5.1 | x |
| Casein | 1.89 | −7.4 | x |
| Polyethylene glycol | 1.73 | 1.7 | □ |
| Oleic acid | 1.66 | 5.7 | □ |
| Polyacrylamide | 2.00 | −13.6 | x |
| None | 1.76 | — | — |

The compounds showing a tensile strength loss of 6% or more in the test above are preferred, and especially those showing a tensile strength loss of 10% or more are suitable for the present invention.

Then, cast-coated papers were prepared using one compound showing good suitability as bonding inhibitor in the test above, KB110 from Kao and evaluated.

Example 1

A coating color containing 100 parts of a Brazilian kaolin (available from Imerys under trade name: Capim DG, volume distribution of particle diameter of 0.4-4.2 μm:71.7%) and 30 parts of a solid plastic pigment (available from NIPPON ZEON Corporation under trade name: V-1004, average particle diameter 0.32 μm, glass transition temperature 85° C.) as pigments; 0.1 parts of sodium polyacrylate as a dispersant; 13.5 parts of a styrene-butadiene copolymer latex (hereinafter abbreviated as SBR) and 3.5 parts of starch as binders; and water to a solids content of 60% was applied on both sides of a base paper having a basis weight of 100 g/m$^2$ containing 100 parts of chemical pulp as papermaking pulp, 12 parts of light calcium carbonate as a filler, and 0.4 parts of KB-110 available from Kao Corporation as an inhibitor of bonding between pulp fibers at a coating mass of 12 g/m$^2$ per side using a blade coater, and dried and then surface-treated by a supercalender.

Thus obtained coated paper was rewetted with a rewetting solution (sodium hexametaphosphate at a concentration of 0.5%) on the surface of the coating layer and then passed through a press nip formed between a forming roll and a casting drum, and pressed/dried against the casting drum at a speed of 100 m/min and a surface temperature of 105° C., and then stripped from the casting drum via a strip-off roll to give a cast-coated paper.

Example 2

A cast-coated paper was obtained by the same procedure as in Example 1 except that the pigments contained in the coating color were 100 parts of a Brazilian kaolin (available from Imerys under trade name: Capim DG, volume distribution of particle diameter of 0.4-4.2 μm: 71.7%) and 22 parts of a solid plastic pigment (available from NIPPON ZEON Corporation under trade name: V-1004, average particle diameter 0.32 μm, glass transition temperature 85° C.).

Example 3

A cast-coated paper was obtained by the same procedure as in Example 1 except that the pigments contained in the coating color were 100 parts of a Brazilian kaolin (available from Imerys under trade name: Capim DG, volume distribution of particle diameter of 0.4-4.2 μm: 71.7%) and 15 parts of a hollow plastic pigment (available from Rohm δ Haas Company under trade name: HP-1055, average particle diameter 1.0 μm, void fraction 55%, glass transition temperature 105° C.).

Example 4

A cast-coated paper was obtained by the same procedure as in Example 1 except that the pigments contained in the coating color were 70 parts of a Brazilian kaolin (available from Imerys under trade name: Capim DG, volume distribution of particle diameter of 0.4-4.2 μm: 71.7%), 30 parts of light calcium carbonate (available from Okutama Kogyo Co., Ltd. under trade name: TP-123 CS), and 30 parts of a solid plastic pigment (available from NIPPON ZEON Corporation under trade name: V-1004, average particle diameter 0.32 μm, glass transition temperature 85° C.).

Example 5

A cast-coated paper was obtained by the same procedure as in Example 1 except that KB-110 available from Kao Corporation was not included as an inhibitor of bonding between pulp fibers in the base paper.

Comparative Example 1

A cast-coated paper was obtained by the same procedure as in Example 1 except that the pigment contained in the coating color consisted of 100 parts of a Brazilian kaolin (available from Imerys under trade name: Capim DG, volume distribution of particle diameter of 0.4-4.2 μm: 71.7%) alone and no solid plastic pigment was added.

Comparative Examples 2

A cast-coated paper was obtained by the same procedure as in Example 1 except that the pigments contained in the coating color were 100 parts of an American kaolin (available from Engelhard Corporation under trade name: Ultrawhite 90, volume distribution of particle diameter of 0.4-4.2 μm: 59.8%) and 30 parts of a solid plastic pigment (available from NIPPON ZEON Corporation under trade name: V-1004, average particle diameter 0.32 μm, glass transition temperature 85° C.).

Comparative Example 3

A cast-coated paper was obtained by the same procedure as in Example 1 except that the pigments contained in the coating color were 45 parts of a Brazilian kaolin (available from Imerys under trade name: Capim DG, volume distribution of particle diameter of 0.4-4.2 μm:71.7%), 55 parts of an American kaolin (available from Engelhard Corporation under trade name: Ultrawhite 90, volume distribution of particle diameter of 0.4-4.2 μm: 59.8%) and 30 parts of a solid plastic pigment (available from NIPPON ZEON Corporation under trade name:V-1004, average particle diameter 0.32 μm, glass transition temperature 85° C.).

The results are shown in Table 2. In Table 2, the designation □-o means a rating between o and □.

TABLE 2

| | | Ex. 1 | Ex. 2 | Ex. 3 | Ex. 4 | Ex. 5 | Com. ex. 1 | Com. ex. 2 | Com. ex. 3 |
|---|---|---|---|---|---|---|---|---|---|
| Pulp bonding inhibitor | | 0.4 | 0.4 | 0.4 | 0.4 | — | 0.4 | 0.4 | 0.4 |
| Inorganic pigment | Capim DG | 100 | 100 | 100 | 70 | 100 | 100 | — | 45 |
| | Ultrawhite 90 | — | — | — | — | — | — | 100 | 55 |
| Organic pigment | TP-123CS | — | — | — | 30 | — | — | — | — |
| | V-1004 | 30 | 22 | — | 30 | 30 | — | 30 | 30 |
| | HP-1055 | — | — | 15 | — | — | — | — | — |
| Sheet gloss before rewetting (75°) (%) | | 74 | 72 | 73 | 74 | 72 | 50 | 69 | 68 |
| Distinctness of image (%) | | 87 | 85 | 83 | 76 | 78 | 32 | 70 | 78 |
| Sheet gloss 20° (%) | | 45 | 40 | 37 | 42 | 32 | 16 | 40 | 41 |
| Print gloss 20° (%) | | 50 | 45 | 42 | 44 | 39 | 15 | 33 | 30 |
| Cast coatability | | ○ | ○ | ○ | ○ | □-○ | ○ | x | □ |

The invention claimed is:

1. A process for preparing a cast-coated paper comprising:

applying a coating color comprising a pigment and an adhesive on a base paper containing an organic compound having the effect of inhibiting interfiber bonding of pulp to form a coating layer, drying the coating layer in a wet state, smoothing the dried coating layer, rewetting the smoothed layer, and pressing and drying the coating layer against a heated mirror finishing surface to form a finished cast coating layer, wherein the coating color contains not less than 50 parts by weight of a kaolin based on 100 parts by weight of inorganic pigments, and wherein the kaolin has a particle size distribution such that not less than 65% by volume of the particles are in the range of 0.4-4.2 μm and the cast coating layer contains a plastic pigment.

2. The process for preparing a cast-coated paper of claim 1 wherein the coating layer has a sheet gloss of 70% or more as measured according to JIS-P8142 after drying and before rewetting.

3. The process of claim 1, wherein the plastic pigment is contained in an amount of 5-50 parts by weight per 100 parts by weight of the inorganic pigments.

4. The process of claim 1, wherein the coating color comprises a solid plastic pigment.

* * * * *